US005147513A

United States Patent [19]

Sondergeld et al.

[11] Patent Number: 5,147,513

[45] Date of Patent: Sep. 15, 1992

[54] PROCESS FOR THE PRODUCTION OF A SURFACE STRUCTURE ON PRINTING MECHANISM CYLINDERS FOR OFFSET PRINTING PRESSES

[75] Inventors: Werner Sondergeld; Gerhard Hackelborger, both of Offenbach am Main, Fed. Rep. of Germany

[73] Assignee: MAN Roland Druckmaschinen AG, Fed. Rep. of Germany

[21] Appl. No.: 772,921

[22] Filed: Oct. 8, 1991

[30] Foreign Application Priority Data

Oct. 8, 1990 [DE] Fed. Rep. of Germany ..... 4031860

[51] Int. Cl.[5] ..... C25F 3/14

[52] U.S. Cl. ..... 204/129.65

[58] Field of Search ..... 204/129.65

[56] References Cited

FOREIGN PATENT DOCUMENTS 1962462 10/1970 Fed. Rep. of Germany .

*Primary Examiner*—T. M. Tufariello

*Attorney, Agent, or Firm*—Leydig, Voit & Mayer

[57] ABSTRACT

A process for the production of a surface structure on a printing cylinder for offset printing presses, wherein said cylinder includes a galvanically coated hard chrome surface, comprising applying a thin layer of alkali-resistant negative-resist material to said hard chrome surface, contacting the resist material with a positive raster, irradiating said cylinder to harden a portion of the resist material, removing the unirradiated resist material, and etching said hard chrome surface by forming a circuit with said printing cylinder as the anode, contacting said hard chrome surface with a sodium hydroxide solution which has passed through a cathode, and removing the hardened resist material from said printing cylinder.

16 Claims, 2 Drawing Sheets

PROCESS FOR THE PRODUCTION OF A SURFACE STRUCTURE ON PRINTING MECHANISM CYLINDERS FOR OFFSET PRINTING PRESSES

The invention relates to a process for the production of a surface structure on ground (polished) metal material surface coated galvanically with hard chrome on printing mechanism cylinders for offset printing presses.

Thick hard-chrome coatings of, for example, steel or gray cast iron printing mechanism cylinders for offset printing presses, according to a galvanic process, are generally used in order to make the surfaces of the printing mechanism wearproof and to protect them against corrosion (see, for example, DE-OS 2,602,277).

Upon the applying of the thick hard-chrome coating in a chroming apparatus there follows, as a rule, a shaving aftertreatment by grinding, in order to ensure accuracy of measurement and shape, or else thereby to achieve a desired surface texture of the hard-chrome layer.

The object of the present invention is to create a process that makes it possible to structurize a ground metal material surface coated galvanically with hard chrome, of a printing mechanism cylinder for offset printing machines.

The process of the present invention is illustrated schematically in the accompanying drawings.

Figure 1:
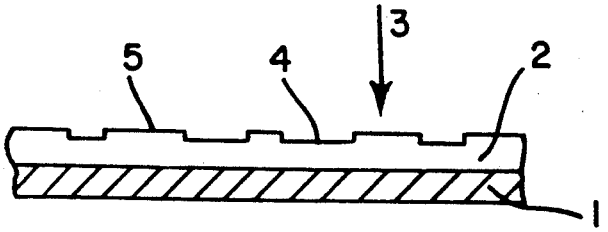
Figure 2:
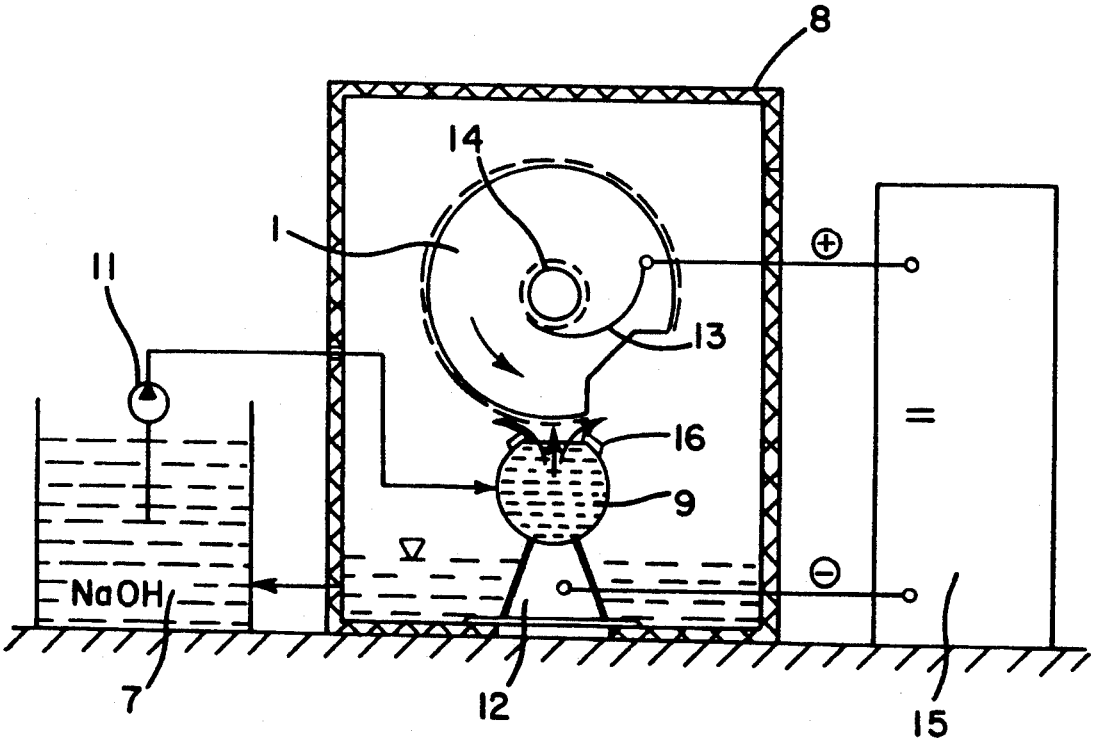
Figure 3:
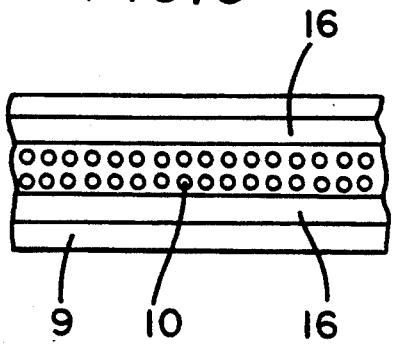
Figure 4:
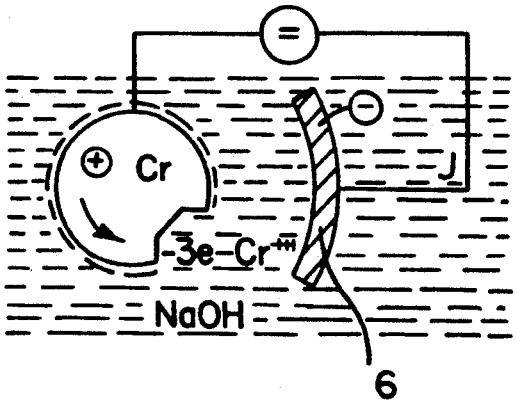

FIG. 1 is a section through the structurized hard-chrome coating according to the invention on a printing mechanism cylinder for offset printing presses, FIG. 2 is the machine scheme of the electrolytic etching method, FIG. 3 a narrow iron-sieve cathode in the form of a hollow cathode in plan view, as cut-out, FIG. 4 the working principle of the electrolytic etching method.

A printing mechanism cylinder 1 is provided with an about 150 $\mu$ thick wearproof and corrosion-proof hard chrome coating 2 which according to FIG. 1 presents in section a relief or a structure 3, which consists of cup-like depressions 4, which are produced between net-type raised parts 5 (crosspieces) directly in the thick hard-chrome coating 2 of the printing mechanism cylinder 1.

The process of the invention proceeds from a printing mechanism cylinder 1, which is hard-chromed in a known manner in a chromium bath (not represented) and, namely, preferably to a thickness of 150 $\mu$ as well as subsequently ground to measure and form accuracy.

The process of the invention is characterized by the following process steps:

To the ground hard-chrome surface of the printing mechanism cylinder 1 there is first applied a thin layer of an alkali-stable negative-resist material. This material should be a good-insulating resist material, electrically good-insulating and chemically stable to strong lyes, for example, soda lye, and should harden after it is exposed to ultraviolet rays. Materials having such properties include special lacquers for electronics, which are built up on the basis of Novolak epoxy-photopolymers. It is a matter there, for example, of a two-component solder-stop lacquer, which is photosensitive and is applied in the spray lacquering process.

It is advantageous to treat the hard-chrome coating by rays before the application of the negatively operating photo-lacquer, in order to achieve an optimal adherence of the coating.

In the second process step a positive raster film is brought into contact with the alkali-resistant negative-resist material. By a positive raster there is meant, as is well known, a raster which has photo-impermeable island-type partial surfaces (points, squares, distorted grains or the like) and presents these surrounding transparent surfaces as a network, as is the case in the relief-printing network raster. The printing mechanism cylinder 1 coated with the alkali-resistant negative-resist material is now exposed under the positive raster film to the action of an ultraviolet light source, in which process light passing through the transparent parts of the film hardens partial surfaces of the negative resist layer into a network.

Suitable copying machines serve for the transferring of the mechanically added (repeating copying machine) or also of handmounted film onto the previously photosensitive printing mechanism cylinder 1 coated with an alkali-resistant negative-resist.

After this operation the unirradiated parts of the alkali-resistance negative-resist layer, i.e. the points, squares or the like, between the network are removed with the organic solvent developer provided by the manufacturer of the alkali-resistant negative-resist material, so that at the hole-type plates freed from the alkali-resistant negative-resist material the electrically conducting material surface of hard-chrome of the printing mechanism cylinder 1 is exposed. The alkali-stable negative-resist layer remains, accordingly, first of all as a contact mask on the hard-chrome coating 2, while unexposed interspaces of the network of the mask remain as openings.

After the development process the insularily exposed hard-chrome material can be depressed electrolytically in cuplike form by means of soda lye (sodium hydroxide solution), as the printing-mechanism cylinder 1 is circuited as anode and the soda lye is sprayed through a narrow iron-sieve cathode arranged at a distance of ca. 4 mm to the material surface of the printing mechanism cylinder 1 along the entire axis. This procedure is based on the insight that slow etching processes can be accelerated by electrolysis (see FIG. 4). The chromium ions migrate under the influence of the electric field from the anodically circuited material surface of the printing mechanism cylinder 1 to the cathode 6. The use of soda lye offers, on the one hand, the advantage of especially smoothly etched cuplets without reinforcement of micro-cracks, and, on the other hand, the base material of the printing mechanism cylinder of cast iron or steel is not attacked by this electrolyte, because in distinction to chromium on iron material, a protective hydroxide layer is formed when strong soda lye acts on it.

In order to achieve usable results, the current densities must present values of ca. 500 amperes per square decimeter, with respect to the total surface, i.e. surfaces of the printing mechanism cylinder 1 covered by photolac and also blank surfaces. In this manner there can be achieved clean and smooth cuplets, without widening pores and micro-cracks in the chromium. The high current density provides for a reasonable processing time, so that the temporal alkali resistance of the negative-resist material is not exceeded. The total current requirement lies between 1000 and 5000 amperes per cylinder, the etching time with a cylinder diameter of 450 mm amounts, for example, to 10 to 80 minutes depending on current flux.

The process temperature of the electrolyte must be maintained at 20° to 30° C. Higher temperatures lead to more rapid detachment of the alkali-resistant negative-resist material, while lower temperatures lengthen the etching time, which is likewise disadvantageous for the time stability of the resist. It is recommended that there be chosen for the stabilization a greater electrolyte volume or to install an additional cooling system. The volume throughput of the electrolyte is set on ca. 200 ltr/min, with use of a cathode surface of 18×1400 mm.

Finally, after the anodic electrolytic removing, the negative-resist material must be removed, which can be accomplished in the case of the above-cited materials, for example, by mechanical grinding.

The devices for the execution of the process are in part commercially known and are explained in detail below. FIG. 2 shows for this the machine scheme schematically. The cathode 6 is constructed as an iron-sieve hollow cathode 9 (see FIGS. 2 and 5). The actual screened processing device 8 has at its disposal receiving possibilities for the hollow cathode 9 and the workpiece, the printing mechanism cylinder 1 carrying the contact mask. During the operating process, by means of a drive of the printing mechanism cylinder 1, turning is performed very slowly during the entire etching process from the starting of printing to the end of printing (only one revolution), in which process a current feed occurs over the tap of the printing mechanism cylinder 1. By the zone-wise contact with the soda lye there is achieved a sparing (gentle treatment) of the negative resist with respect to the alkali. The printing mechanism cylinder does not plunge into the electrolyte of soda lye, but is in contact with the electrolyte only in the narrow etching zone. The protective action of the negative-resist thereby remains optimally preserved. The iron hollow-sieve cathode 9 consists of an iron tube which is arranged underneath the printing mechanism 1 on holding blocks 12 and is provided, facing this, with a flattening, into which the nozzles 10 are introduced, which are provided in axial direction of the printing mechanism cylinder 1 over its entire width. A cut-out in the view from above of the iron-sieve hollow cathode 9 is shown in FIG. 3. The nozzles 10 make it possible, by means of pumps 11, to spray the soda lye steadily in the narrow zone along the printing mechanism cylinder 1. The zone width should preferably be from about 15–50 mm and must not be too large, so that the used electrolyte charged with gas bubbles can be led off as rapidly as possible. In the case of greater cathode widths, additional run-off channels are necessary. The distance of the iron-sieve hollow cathode 9 from the surface of the printing mechanism cylinder should preferably be about 4 mm, in which case with a volume throughput of about 200 ltr per minute on a cylinder length of about 1400 mm a closed film of the electrolyte is formed. The advantage of the zone-wise contact with soda lye is the low burdening of the negative resist material by the soda lye, so that the protective effect of the hardened part of the negative resist remains optimally preserved. The rinsing by the iron-sieve hollow cathode 9 provides, even at high current densities, that in the zone between the hollow cathode 9 and the printing mechanism cylinder 1, in which the electrical performance is converted, there takes place no inadmissibly high heating.

Plastic strips 16 bound the contact zone of the electrolyte with the printing mechanism cylinder 1 laterally and form a stowage space.

Instead of the iron-sieve hollow cathode 9, if a gap nozzle may be used, extends along the printing mechanism cylinder 1 in the narrow range. Preferably there is used 10 to 20% soda lye.

The direct voltage necessary for the electrolysis is delivered by a generator 15, which consists of a transformer for the lowering of the mains voltage to about 10 volts and a rectifier. The generator 15 must, as is well known have at its disposal a short-circuit coverage and a current rapid switch-off, which in the event of a process disturbance not always to be avoided, for example by reason of unfavorable electrolyte flows, prevents short-circuit damages to the cathode and to the cylinder.

The electrolyte supply and its electrolytic preparation consists, as mentioned, of the electrolyte pump 11, one or several electrolyte containers 7 and of a heat exchanger (not shown in the drawing) for the temperature regulation of the electrolyte.

Finally, the installation must also be shielded in order to protect the operating personnel from health hazards, for example by dangerous vapors.

For the equipping of the electrical installations the relevant regulations from the corresponding VDE should be observed, especially in respect to contact protection.

The advantage of the invention lies in that it is possible to produce a grain raster structure of the raster fineness of 20 to 60 lines per cm, for example 20–80 $\mu$ deep directly into an approximately 150 $\mu$ thick hard chrome coating of a printing mechanism cylinder 1 by the electrolytic etching method, effective against doubling, similar to a intaglio form cylinder etching, which hitherto was not possible.

What is claimed is:

1. A process for the production of a surface structure on a printing cylinder for offset printing presses, wherein said cylinder includes a galvanically coated hard chrome surface comprising:

applying a thin layer of alkali-resistant negative-resist material to said hard chrome surface;

contacting said alkali-resistant negative-resist material layer with a positive raster film;

irradiating said cylinder by with radiation having a wavelength sufficient to harden at least a portion of the surface of said alkali-resistant negative-resist material layer;

removing the unirradiated portion of said alkali-resistant negative-resist layer to expose said hard chrome surface;

and etching said hard chrome surface, said etching comprising forming a circuit with said printing cylinder as the anode and cathode means capable of passing a solution therethrough;

contacting said hard chrome surface with a solution of from about 10 to about 20 percent by weight sodium hydroxide, said solution being passed through said cathode means; and removing said hardened partial surfaces of said alkali-resistant negative-resist layer from said printing cylinder.

2. A process according to claim 1, wherein the current density of said anode is at least 300 amperes per square decimeter.

3. A process according to claim !, wherein the solution is maintained at a temperature of from about 20° C. to about 30° C.

4. A process according to claim 2, wherein the temperature of said solution is maintained at about 20° C. to about 30° C.

5. A process according to claim 1, wherein in that the volume throughput of said solution is maintained at at least about 200 liters per minute.

6. A process according to claim 2, wherein in that the volume throughput of said solution is maintained at at least about 200 liters per minute.

7. A process according to claim 3, wherein in that the volume throughput of said solution is maintained at at least about 200 liters per minute.

8. A process according to claim 1, wherein said radiation is ultraviolet.

9. A process according to claim 8, wherein the current density of said anode is at least 300 amperes per square decimeter.

10. A process according to claim 8, wherein said solution is maintained at a temperature of from about 20° C. to about 30° C.

11. A process according to claim 8, wherein the volume throughput of said solution is at least about 200 liters per minute.

12. A process according to claim 1, wherein said hard chrome surface is contacted with said solution during a single rotation of said printing cylinder.

13. A process according to claim 12, wherein the current density of said anode is at least 300 amperes per square decimeter.

14. A process according to claim 12, wherein said solution is maintained at a temperature of from about 20° C. to about 30° C.

15. A process according to claim 12, wherein the volume throughput of said solution is at least about 200 liters per minute.

16. A process according to claim 1, wherein said cathode means is an iron sieve hollow cathode.

* * * * *